US005555163A

United States Patent [19]

Pisani

[11] Patent Number: 5,555,163

[45] Date of Patent: Sep. 10, 1996

[54] MINIATURE LIGHT DISPLAY

[76] Inventor: Richard R. Pisani, 2205 Ashley Park, Plano, Tex. 75074

[21] Appl. No.: 386,160

[22] Filed: Feb. 9, 1995

[51] Int. Cl.[6] ..... G09F 13/00

[52] U.S. Cl. ..... 362/252; 362/231; 362/255; 362/456; 446/485; 446/118; 40/452; 40/550

[58] Field of Search ..... 362/252, 293, 362/456, 806, 812, 231, 255; 446/485, 118; 434/96; 40/550, 451, 452

[56] References Cited

U.S. PATENT DOCUMENTS

| | | | |
|---|---|---|---|
| 2,165,835 | 7/1939 | Brady et al. | 362/456 |
| 2,795,879 | 6/1957 | Bliss | 41/15 |
| 3,096,943 | 7/1963 | Forrer . | |
| 3,191,020 | 6/1965 | Miller . | |
| 3,568,357 | 3/1971 | Lebensfeld | 446/118 |
| 3,607,582 | 9/1971 | Horacek | 156/584 |
| 3,731,081 | 5/1973 | Yellin . | |
| 3,819,459 | 6/1974 | Wren | 161/23 |
| 4,537,806 | 7/1985 | Sherrard | 428/7 |
| 4,577,264 | 3/1986 | Plumly | 362/252 |
| 4,657,800 | 4/1987 | Long | 428/102 |
| 4,667,276 | 5/1987 | Cheng | 362/249 |
| 4,682,079 | 7/1987 | Sanders et al. | 315/186 |
| 4,769,749 | 9/1988 | Felski | 362/252 |
| 4,891,030 | 1/1990 | Gertzfeld | 446/485 |
| 4,917,448 | 4/1990 | Oppenheimer | 362/32 |
| 4,966,793 | 10/1990 | Covell | 428/7 |

*Primary Examiner*—Denise L. Gromada
*Assistant Examiner*—Sara Sachie Raab
*Attorney, Agent, or Firm*—John W. Montgomery; Ross, Clapp, Korn & Montgomery, L.L.P.

[57] ABSTRACT

A miniature light string display container for selectively displaying a plurality of light bulbs of a miniature light string in a desired arrangement, including a container with a front display panel having an array of regularly spaced mounting openings therethrough, which openings are sized for securely receiving light bulbs of a light string at least partially therethrough in a desired arrangement or pattern which is selectable on the array of mounting openings. The display container also includes a reversibly openable entry panel with a closed position and an open position, in which open position a rear surface of the display panel may be accessed. Electrical connection wire is extendable through the display container, when closed, for connecting the string of lights to an electrical power source, so that the pattern of inserted light bulbs is illuminated.

22 Claims, 6 Drawing Sheets

MINIATURE LIGHT DISPLAY

TECHNICAL FIELD OF THE INVENTION

The present invention relates an ornamental light display, and in particular, to a versatile light display usable with standard strings of miniature light bulbs for holding light bulbs in a selectably changeable ornamental design for visible display.

BACKGROUND OF THE INVENTION

Strings of miniature lights with standardized sizes have become popular in recent years for decoration and ornamentation during a holiday season, such as Christmas, New Year's, Hanukkah, Independence Day, and the like—celebrations, as well as for purposes of ornamental displays, as in advertising or product promotion. Typically, these strings of lights are arranged on tree branches, along rooftop eaves and edges, around windows, on bushes and around product displays or business signage. These light strings operate with low wattage small or miniature light bulbs, connected in a series along connecting wires which are properly insulated for either indoor or outdoor use. Through standardization of size and through means of mass production, these light strings have become relatively inexpensive to produce and operate with a low amount of electricity for highly visible, pinpoint illumination.

For purposes of display presentation, pluralities of lights have been presented with sockets arranged in predetermined ornamental presentations. Also, specific, predetermined ornamental presentations have been accomplished using a board or other support structure having holes formed therein arranged in a fixed design. The arrangement or configuration is predetermined by the manufacturer, so that lights on a string of lights can be inserted and held in the preset arrangement, for example as set forth in U.S. Pat. Nos. 3,731,081 and 4,966,793. In each instance, however, the design presented is predetermined by the manufacturer and results from insertion of the light bulbs according to instructions into fixed openings which present only a single design in any given board. Other devices have been provided by which light sockets are fixed in a display having a fixed arrangement, such as the Christmas tree designs of U.S. Pat. No. 3,819,459 and U.S. Pat. No. 4,537,806. Selectable designs or personalization of designs for different occasions are not available with the fixed design devices.

Further, boards which present the bulbs through openings which hold the bulb and socket of a string of lights typically leave the wires of the string exposed toward the rear and may require special securing, taping or fastening in order to avoid an unsightly appearance from the rear. Indoor uses are typically desirable for such presentations, because there is no additional protection for the exposed sockets and wiring.

There continues to be a need for a display, useful with standardized miniature light strings, which are economical to manufacture and operate. Further, there is a need for a light display in which the design is selectable, personalizable and individually createable by the user and which does not require a specifically manufactured orientation of the light-holding orifices for any user's desired light presentation. Applicant's inventive miniature light display overcomes these drawbacks and provides other additional advantages.

SUMMARY OF THE INVENTION

The present invention overcomes many of the drawbacks of the prior art and provides additional advantages by providing a light display, having at least one display panel, having a multiplicity of light-holding orifices or mounting openings arranged in a regularly spaced grid pattern or an evenly spaced array, substantially entirely covering an entire area of at least one display panel and sized for securely but removably holding standard size light bulbs of one or more miniature light bulb strings, which receive electrical power by which the light display is illuminated.

Another aspect of the invention is the construction of the display in the form of a container, which has a reversibly closable access panel by which the container is openable for insertion of the lights into the desired orifices for selectably forming a desired arrangement and by which the container is closable after such insertion, so that the wires of the light string are enclosed. The unwieldy and unsightly entanglement of wires from the light strings are hidden from view and are protected from direct exposure to the elements as may be present in the display environment.

Another aspect of the invention is that it may be constructed of inexpensive cardboard material for indoor use or relatively inexpensive corrugated plastic sheets for outdoor use. The construction is both lightweight and cost-effective. The same uniform array of mounting openings, such as a grid pattern, can be universally used without requiring special hole patterns for any particular design, arrangement, seasonable presentation or individualized display or advertisement. Further, the display can be constructed with one panel, or with multiple panels, multi-faceted or three-dimensional polygon shapes, or even for three-dimensional shaped displays with curved surface display panels, as with hemispheres, spheres and cylinders.

Another aspect of the invention is that an opaque interior cover sheet of paper, preferably black, can be provided which can be placed over the orifices and held inside of the display container. The user can punch through the paper only at orifices corresponding to the desired design. Suggested patterns or a multiplicity of suggested pattern outlines may be drawn on the opaque sheet to allow the user to choose a desired pattern. The unpunched areas of the opaque sheet blocks unwanted light projection through the preformed array of orifices which are not part of the desired light display pattern.

BRIEF DESCRIPTION OF THE DRAWINGS

The foregoing objects, advantages, and features, as well as other objects and advantages, will become more apparent with reference to the description and drawings below, in which like numerals represent like elements and in which.

DETAILED DESCRIPTION OF THE PREFERRED EMBODIMENTS

Figure 1:
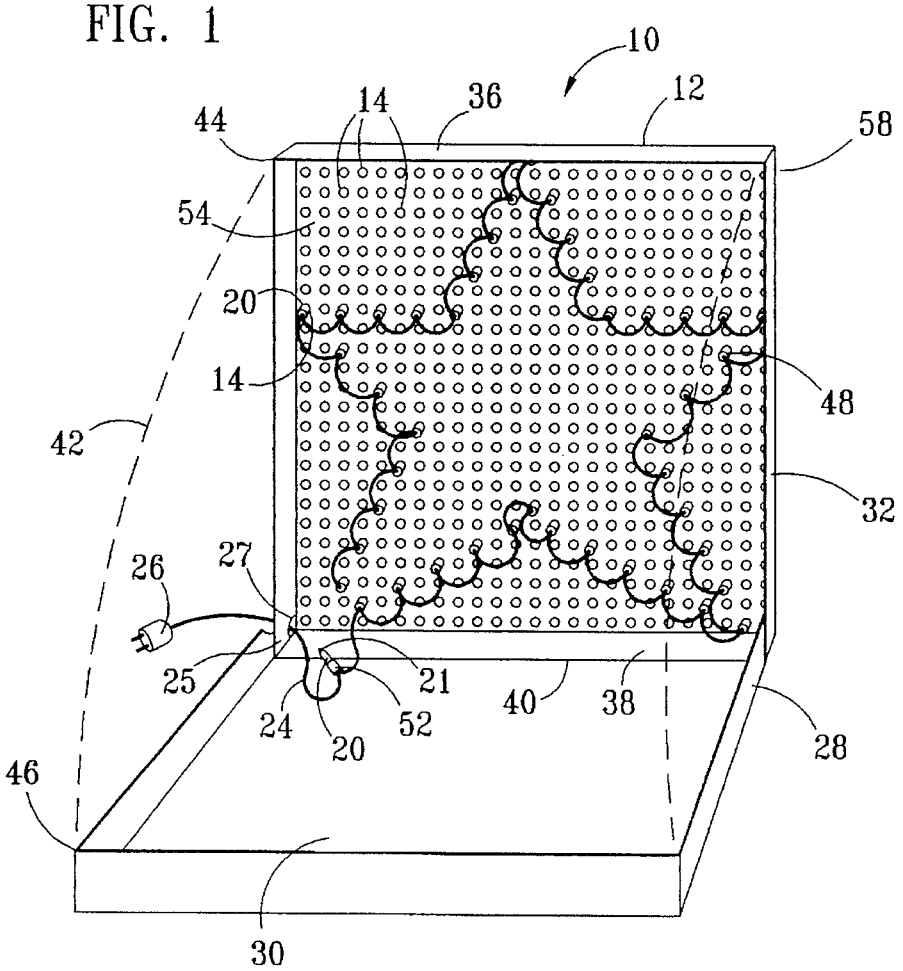
FIG. 1 is a perspective view of a miniature light string display container, according to one embodiment of the present invention.

Referring to FIG. 1, which is a schematic perspective view of a miniature light string display container, taken from a rear perspective, by which various aspects of the present invention will be more fully understood. The light display, container is designated generally as 10. the container 10 may be formed in a variety of shapes and includes at least one display panel 12. The display panel 12 may be integrally formed with the container or may be separately attached and may be constructed of a variety of materials, including corrugated cardboard, corrugated plastic, sheets of wood or sheet of plastic, or the like. Preferably corrugated cardboard is used for indoor applications and plastic and preferably corrugated plastic is used for outdoor applications to facilitate strength and protection from weather or other environmental elements. A plurality of light-holding orifices 14 are formed through the display panel 12 in an array 16 of regularly spaced orifices 14, such as the closely spaced grid pattern 16, as depicted. Preferably, the light-holding orifices 14 are the size for securely holding standard size light bulbs 20, which miniature light bulbs typically are available on light bulb strings 22, including interconnecting wires 24 and a power-receiving plug 26. The closely-spaced grid pattern 16 is preferably a substantially regular array or pattern of holes formed in the display panel 12 and covering substantially the entire display panel 12 corresponding to a desired selectable work or display area 18. It will be noted that the area 18 is preferably a generalized area so that a large variety of patterns can be selected according to the positions of the selected orifice 14 into which bulbs 20 of the light string 22 are inserted. Area 18 might for example be an area (not shown) covering less than the entire display panel surface 12 but preferably and advantageously the array 16 of orifices 14 covers the entire area of panel 12 to provide maximum design display versatility.

Figure 2:
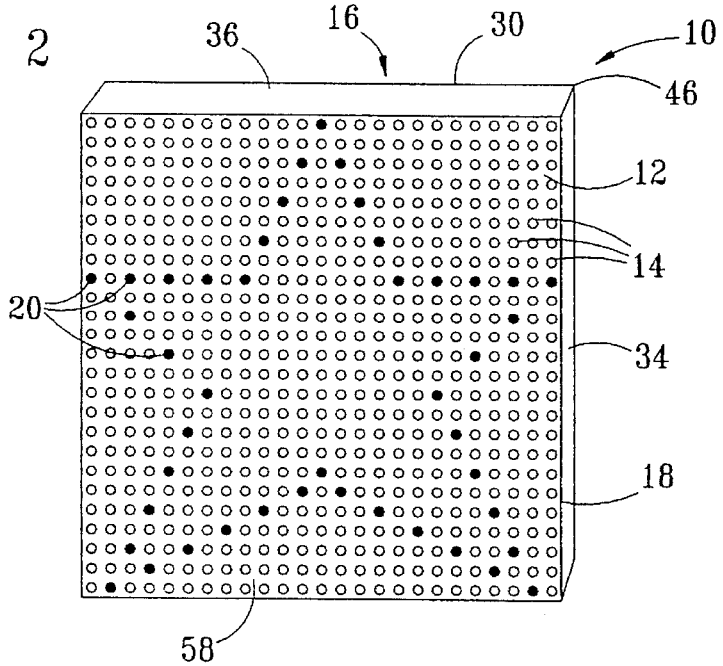
FIG. 2 is a front view of the display panel of the light display container of FIG. 1.

FIG. 2 is a front perspective view of the light display 10 of FIG. 1. Viewing FIGS. 1 and 2, it can be seen that one preferred embodiment of the display container 10 is in the form of a shallow light display box 28. In the embodiment shown, the light display container 10, comprises a light display box 28, having a display panel 12, a reversibly openable access panel 30, a first side panel 32, a second side panel 34, a third side panel 36, and a fourth end side panel 38. The reversibly openable access panel 30 and the front display 12 panel are preferably attached to each other at a hinge 40, which hinge 40 may be at a bendable fold line 40 formed in the material from which the miniature light display box 28 is constructed. The use of a bendable crease or fold line 40 in materials, such as corrugated cardboard or corrugated plastic is a convenient and a cost-effective method for manufacturing a closeable light display container according to the present invention.

A light display container 10 according to the present invention preferably has an open position 44, depicted as a pivoted open position 44 in FIG. 1; The light display container 10 also desirably has a closed position 46, depicted as a pivoted closed position 46 in FIGS. 1 and 2. The depiction in FIG. 2 is shown in a closed position 46. The access panel 30 moves toward and away relative to the display panel 12 and preferably pivots for movement along any arcuate path 42. In the embodiment depicted in FIGS. 1 and 2, the pivoting action is essentially about hinge 40 between a closed position 46 at which access panel 30 is spaced apart parallel and adjacent to the display panel 12 and to an open access position 44, at which access panel 30 is positioned away from display panel 12.

Advantageously, with a plurality of uniformly, closely-spaced light mounting orifices 14 of the array 16, according to the present invention, a large variety of desired display patterns 48 (which, in the case of FIGS. 1 and 2, is a star-shaped light display) can be selectively formed by the user from a single display box. The cost for manufacturing a variety of specific fixed display patterns is avoided, so that the display container 10 according to this invention can be made by mass production on a cost-effective basis. Further, the individual user can selectively display any desired pattern 48 with the same miniature light string display container 10 without requiring the purchase of separate display devices for separate patterns to be displayed.

It has been found that for great versatility of design possibilities, the array 16, or grid pattern 16 can be formed with mounting orifices 14, evenly spaced apart at intervals of about ½ inch to about 1 inch on center when standard size miniature light bulbs are used. Currently, standard size miniature light bulbs have an outside diameter of 0.20 inches (25 mm.). Preferably, with the 25 mm. bulbs, a grid pattern 16 with mounting holes 14 spaced apart a center to center distance of between about 0.60 inches and 0.75 inches, provides a versatile display configuration. Adequate illumination is also obtained without overcrowding. As will be discussed more fully below, slightly larger center-to-center hole spacing may be desirable for embodiments in which standard miniature light bulbs are used in combination with bulb lenses.

Further, advantageously, with the use of conveniently available miniature light strings, the interconnecting wire 24 from one light bulb 20 to the next light bulb 20, can be conveniently and advantageously enclosed within the closeable light display container 10 so that unsightly exterior appearance is avoided and a neat, clean appearance is presented. The wire 24 connecting the bulbs 20 inside of the display container extends outside of the container to a plug 26, by which the light string is connectable to a power source (not shown) for illuminating the desired pattern. The wire 24 may exit the container at a flexible overlapping portion at the corner 25, or, alternatively, an exit opening 27 may be formed, as at corner 25. Further, with standardly available miniature light bulbs, the glass portion 21 of the light bulbs 20 extend from bulb bases 52 or housings 52, which bases are typically made of an opaque material. A light bulb with glass portion 21 fully inserted into a mounting orifice 14, causes the bulb housing 52 or base 52 to be pressed against the rear surface 54 of the display panel 12. Advantageously where the mounting orifice 14 is sufficiently small, the base 52 occludes any light which might otherwise radiate from the bulb inside of the closed display container 10. This reduces reflective illumination through open mounting orifices 14, which do not receive inserted light bulbs. For this purpose circular mounting orifices 14 are advantageous.

The thickness 56 of the display panel 12 is preferably, a thickness that provides sufficient rigidity to maintain the display panel without undue flexing, and further is sufficiently thick, in combination with the size of mounting hole 14, to rigidly secure each inserted light bulb 20. Thus, the light bulbs are pressed through the orifices and partially extend beyond the face 58 of the display panel 12. As discussed above, the outside diameter 60 of the light bulb 20 has been standardized to a large extent in the industry, for miniature light bulb 20 manufacturing. Each light bulb on miniature light strings made by any one of various manufactures is substantially identical in size to the miniature light bulbs made by other manufacturers. Thus, one can generally rely on all miniature light bulb strings conforming to a standard size of 25 mm. Thus, with respect to partially deformable materials, such as corrugated cardboard, corrugated plastic, or other similar materials from which display panels and display containers can be constructed, the mounting orifices 14 are provided with an inside diameter 61 slightly smaller than the standard O.D. 60 of the bulbs. For a circular mounting orifice 14 (as in FIG. 15 below) the inside diameter (I.D.) 61 is advantageously smaller than the bulb O.D. 60 approximately 0.01 inches (0.25 min.). Thus, the I.D. is 0.19 inch for a standard 0.20 inch O.D. light bulb to provide an adequate, snug fit. In the embodiments shown in FIGS. 17 and 18, below, where non-circular mounting orifices are provided, the diameter of the maximum size circle inscribable within the opening should also be smaller than the O.D. 60 of the bulb glass portion 21 to provide a snug fit.

Figure 3:
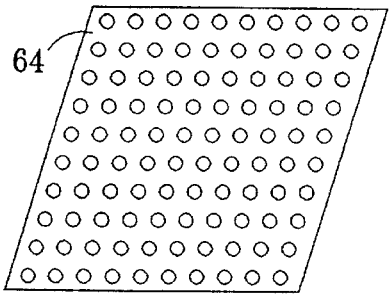
FIG. 3 is an alternative embodiment of a light display container, according to the present invention, in which the display panel shape is trapezoidal.
Figure 4:
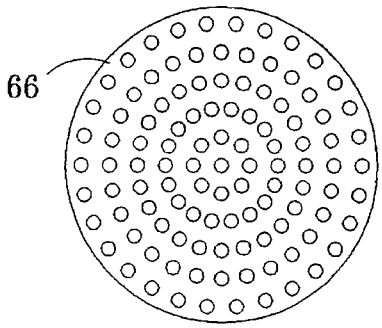
FIG. 4 is another alternative embodiment of a light display container, according to the present invention, in which the display panel shape is circular.
Figure 5:
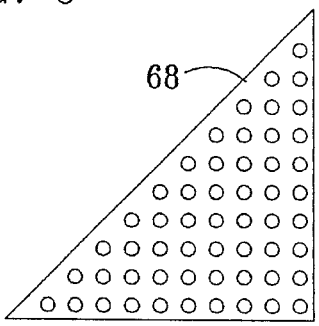
FIG. 5 is another alternative embodiment of a light display container, according to the present invention, in which the display panel shape is triangular.
Figure 6:
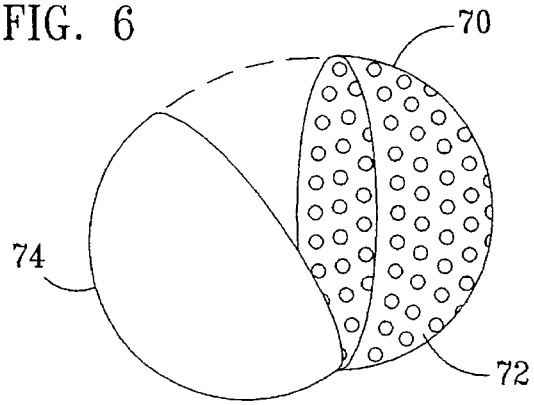
FIG. 6 is another alternative embodiment of light display container, according to the present invention, in which the display container shape is spherical.
Figure 7:
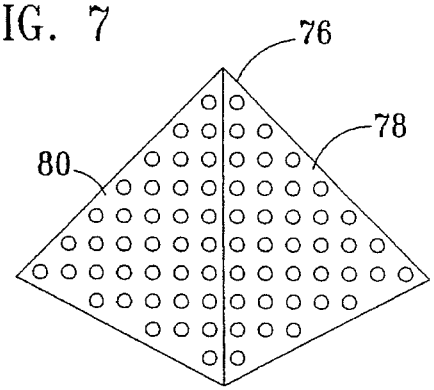
FIG. 7 is another alternative embodiment of a light display container, according to the present invention, in which the light display container shape is cylindrical.

With reference to FIGS. 3–7, various alternative embodiments are depicted, by way of example to show the applicability of the present invention to a variety of possible light display container and display panel configurations. FIG. 3 depicts a trapezoidal shaped light display panel 64, FIG. 4 depicts a circular shaped light display panel 66 and FIG. 5 depicts a triangular shaped light display panel 68. FIG. 6 depicts a spherical light container 70 in which the display panel 72 may be in the shape of a spherical arc, a hemispherical shape or a completely spherical shape. Of course, a reversibly closable access panel 74 provides the ability of the use to open the light display container 70 to selectably insert miniature light bulbs 20 in orifices 14 in order to obtain a selectable variety of desired exterior light displays. FIG. 7 depicts a cylindrical-shaped display container 76, according to another alternative embodiment of the present invention.

Figure 8:
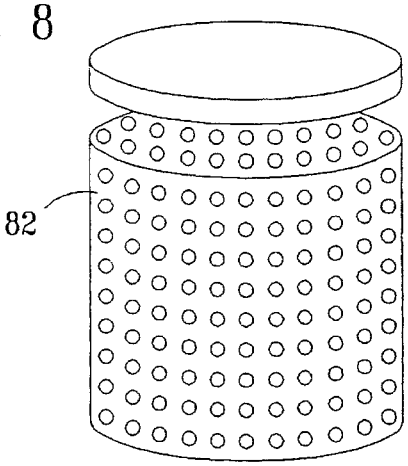
FIG. 8 is another alternative embodiment of a light display container, according to the present invention, in which a light display container is pyramid-shaped, having a plurality of triangular-shaped display panels.

FIG. 8 depicts a pyramid-shaped light display container 78, according to an alternative embodiment of the present invention, in which a plurality of panels 80 and 82—which, in this case, are triangular-shaped panels 80 and 82—are provided with an array 16 of orifices 14 for the insertion of miniature light bulbs 20 each inter-connected along light strings 22 according to the present invention.

Figure 9:
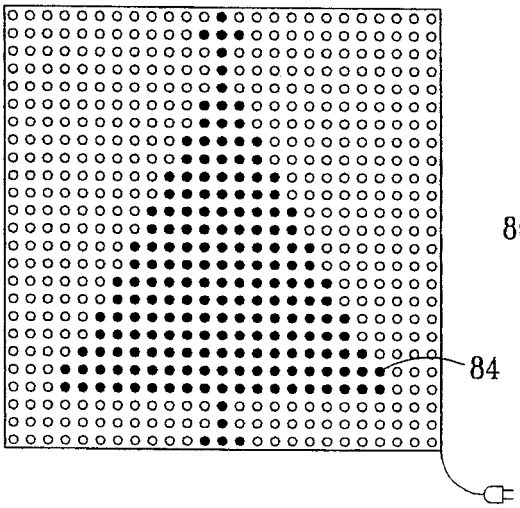
FIG. 9 is a schematic depiction of a display panel with a Christmas display decoration selectably formed thereon.
Figure 10:
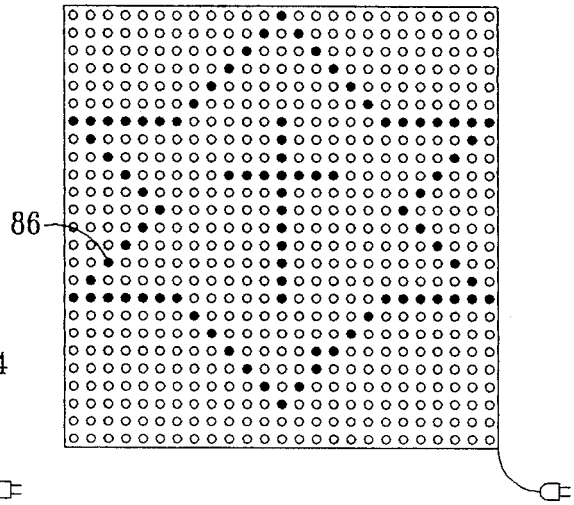
FIG. 10 is an schematic view of a display panel of a light display container, according to the present invention, having a religious display selectably formed thereon.
Figure 11:
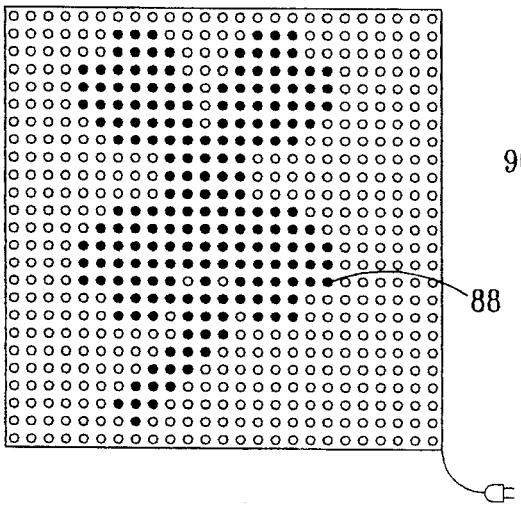
FIG. 11 is a schematic view of a front panel of a light display container, according to the present invention, having a St. Patrick's Day symbol displayed thereon.
Figure 12:
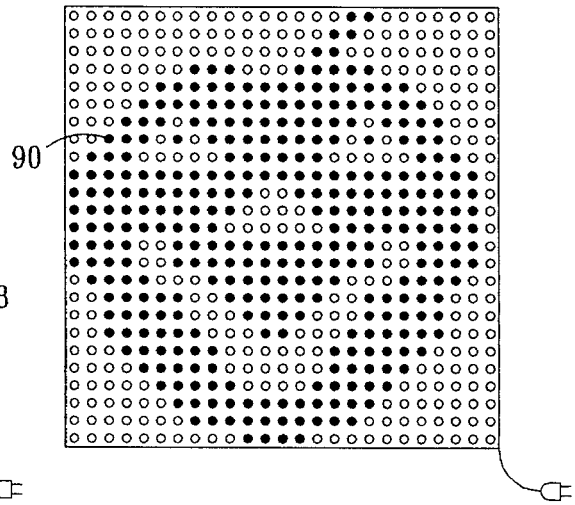
FIG. 12 is a schematic depiction of a Halloween design displayed on a light display container, according to the present invention.
Figure 13:
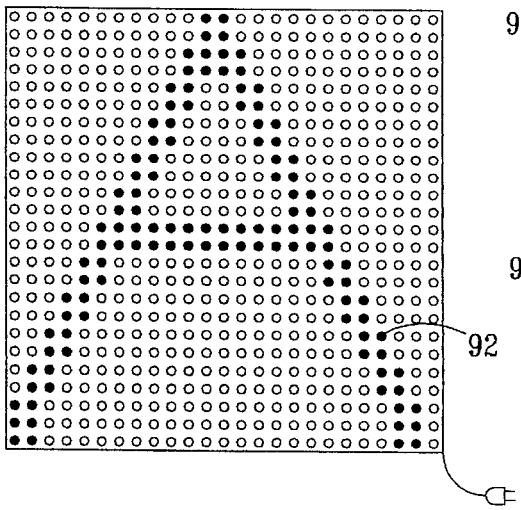
FIG. 13 is an alternative display, having a letter "A", such as might be an initial for a person's name, selectably formed for display thereon.
Figure 14:
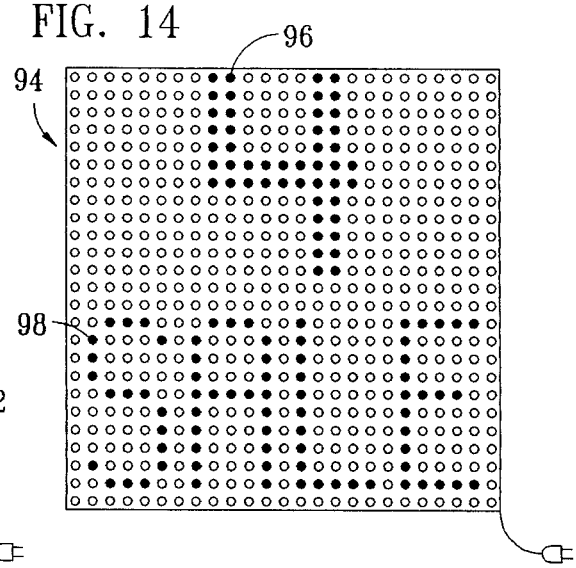
FIG. 14 is a schematic depiction of a light display, having an advertisement-type sign display depicted thereon.

With reference to FIGS. 9–14, the versatility and selectability of the light displays is demonstrated, by way of example, each figure depicts a sample display for a variety of celebrations, occasions, or purposes, FIG. 9 depicts a Christmas light display 84, as for example, a Christmas tree display 84. FIG. 10 depicts a religious display 86. FIG. 11 schematically depicts a St. Patrick's Day symbol 88 as a selected light display, such as a shamrock 88. FIG. 12 depicts a Halloween light display 90, such as a jack-o-lantern 90. FIG. 13 depicts the display of an initial 92 or a letter 92, such as the letter "A". FIG. 14 depicts a sign light display 94, which may be an advertisement and which may include numeric symbols such as "4" as at 96, or letters and/or words such as "SALE" as at 98.

Figure 15:
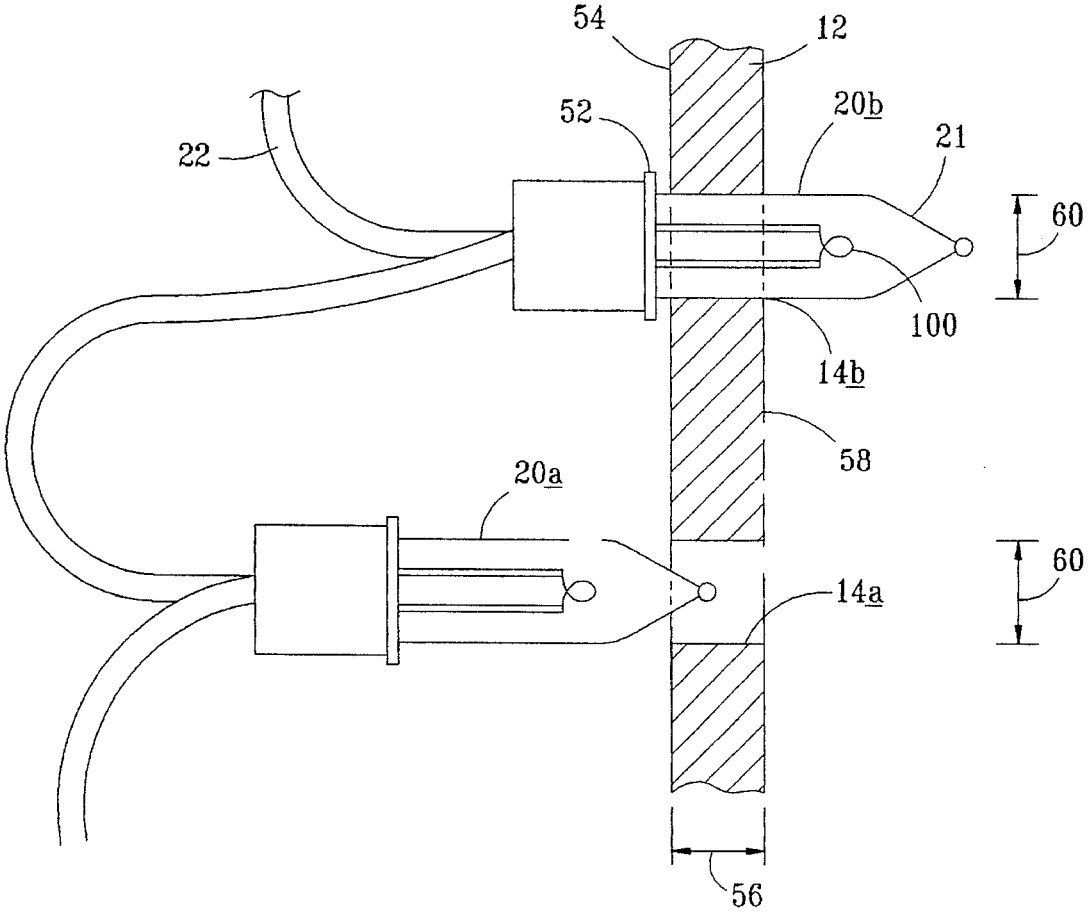
FIG. 15 is a partial cross-sectional view of a portion of a display panel taken through adjacent mounting orifices with standard miniature light bulbs of a light string inserted thereinto.

Further understanding of light bulb insertion through the display panel 12 will be had with reference to FIG. 15, which is a partial side cross-sectional view schematically depicting the insertion of light bulbs 14 of a light string 22. In this embodiment, a light bulb **20*a* is shown prior to insertion into any open mounting orifice 14*a* and a light bulb 20*b* is shown inserted into occupied mounting orifice 14*b*. The base 52 is securely positioned against rear surface 54 of display 12, such that a glass portion 21 of the inserted light bulb 20*b* projects beyond the front surface 58 of display panel 12. Preferably a portion of the filament 100 of light bulb 20*b* also projects beyond the front surface or face 58 of the display panel 12. With a bulb O.D. of 0.20 inches (25 mm.), the inside diameter of the unoccupied orifice 14*a* is advantageously about 0.19 inches (4.75 mm.). The display panel 12, which is advantageously corrugated cardboard or corrugated plastic having a thickness 56 (as one might find in pizza boxes), adequately expands under hand applied pressure on the bulb 20 to diameter of 0.20 inches (25 mm.). This rigidly holds the inserted bulb 20*b* firmly in orifice 14*b***.

Figure 16:
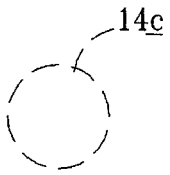
FIG. 16 is a schematic representation of an mounting orifice shape or a mounting hole shape, which shape is circular as in a preferred embodiment of the invention.
Figure 17:
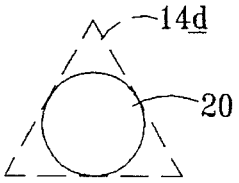
FIG. 17 is a schematic representation of an alternative shape for a light bulb mounting hole, which is triangular.
Figure 18:
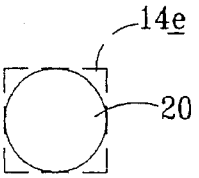
FIG. 18 is a schematic depiction of another alternative mounting hole shape, which is square.

FIGS. 16, 17 and 18, each schematically depict alternative shapes for light bulb mounting holes 14. FIG. 16 shows a circular mounting hole **14*c*, which is preferred for providing mounting rigidity. A circular shape is also preferred for purposes of occluding back light from entering into a closed light display container. FIG. 17 shows a triangular-shaped mounting hole 14*d* which may advantageously accommodate bulbs having slightly varied sizes as might result from loose manufacturing tolerances. FIG. 18 shows a square-shaped mounting hole 14***e*, which increases the number of holding contact surfaces over the triangular shape of 14*d*, while still allowing additional deformation of the panel 12 as might be required to accommodate larger manufacturing tolerances. It will be understood that other mounting hole shapes may be used without departing from described aspects of the present invention. It will be further understood that it is advantageous to size the orifice 14 according to the diameter of a circle inscribable within the orifice. The diameter of such an inscribed circle should be as small as one might expect the smallest bulb size to be due to permitted tolerances for standard size outside diameter of a typical miniature light bulb. It has been found that about 0.01 inch (0.25 mm.) smaller than the nominal size of 0.20 (25 mm.) inches will accommodate most variations from one bulb to the next and also from on manufacturer to the next.

Figure 19:
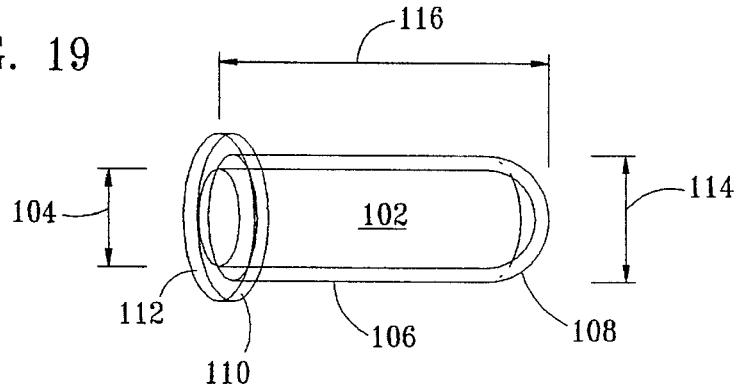
FIG. 19 is a perspective view of a translucent light bulb lens, designed according to another aspect of the present invention for receiving a light bulb and for insertion therewith into a mounting orifice through a display panel.

FIG. 19 depicts an alternative aspect of the present invention in which the light display further includes light bulb lenses 102, which are preferably made of a transparent material preferably, the lenses are of a variety of colors. The inside diameter 104 of such lenses 102 is preferably about 0.20 up to about 0.21 inches (about 25.0 to 25.25 mm.). So that the largest expected of standard size miniature light bulbs may be accommodated. The lens 102 is preferably cylindrical along its sides 106, with a rounded closed tip 108. A larger flange 110 or rim 110 is formed at base 112 of the lens 102. Further the lenses 102 may be approximately 0.80 inches long (about 20 mm. long). A unique light display of any desired arrangement can be created by the user a plurality of a variety of different color lenses 102.

Figure 20:
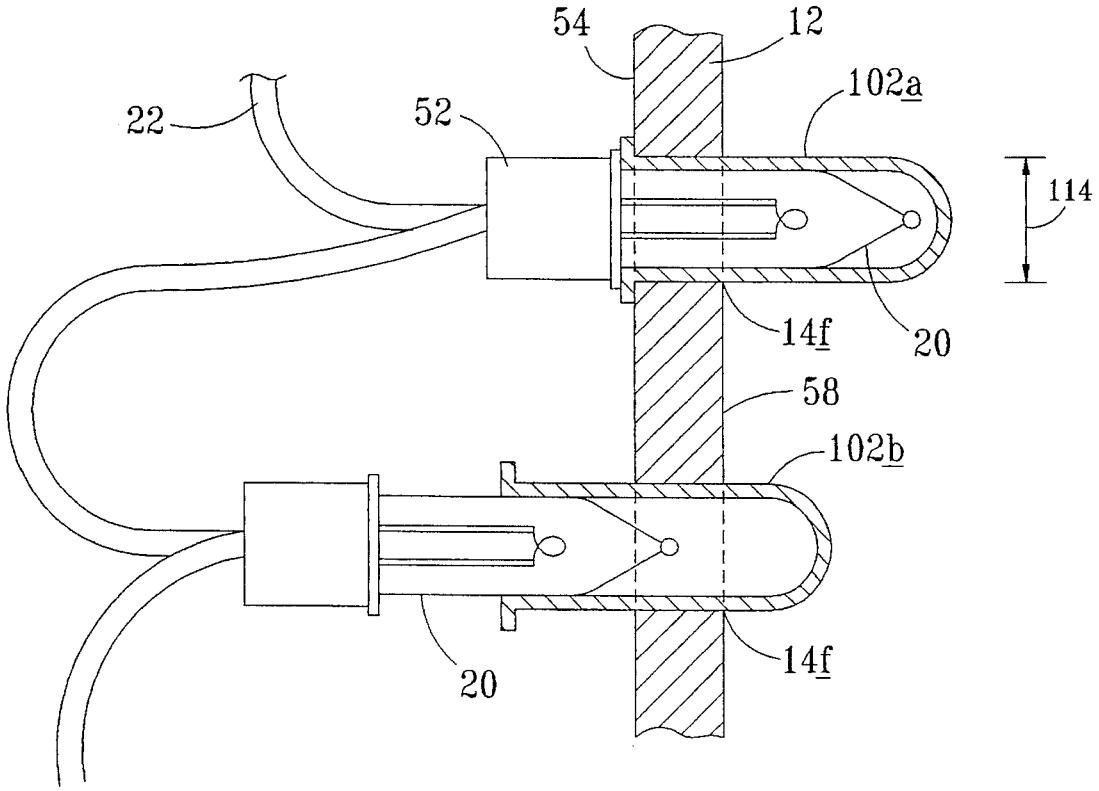
FIG. 20 is a partial side cross-sectional view of a light display, according to an embodiment of the present invention, in which a translucent lens is inserted into a selected mounting orifice along with a miniature light bulb, according to one aspect of the present invention.

As shown in FIG. 20, a lens 102*a* may be inserted through a mounting orifice 14*f*, which has an inside diameter sized for accommodating the outside diameter 114 of the lens 102. The size of mounting orifice 14*f* for accommodating a lens 102 is larger than the outside diameter of the standard miniature light bulb by about twice the lens material thickness. This allows both the light bulb 20 and the lens 102 to be securely held within the larger orifice 14*f*. An array 16 of larger orifices will be formed for light display containers 10 which are intended for use with multi-colored lenses 102. The lenses may be advantageously transparent or translucent, having different colors so that a variety of colorful light displays can be selectively presented, even when light strings 22 comprising clear or white bulbs 20 are used. The use of such lenses 102, in combination with clear light bulbs 20, advantageously facilitates convenient color selection for design presentation. Such color selection might otherwise be less conveniently accomplished using light strings having a variety of colored light bulbs thereon. Placing the desired colors of bulbs at the appropriate sequential position along the light string has been found to be less convenient than the use of selectable colored lenses 102 for providing the desired color light display.

Figure 21:
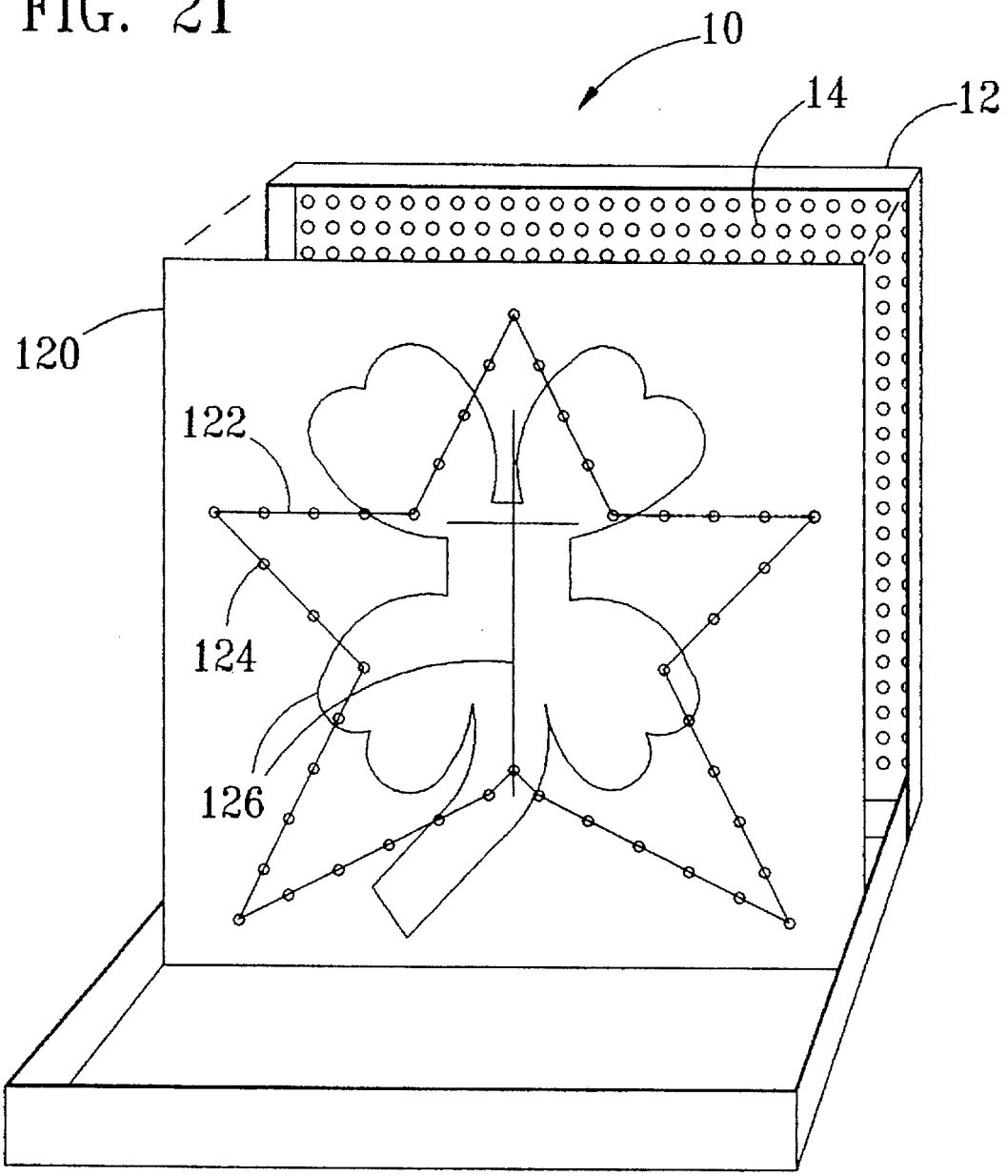
FIG. 21 is a perspective view of a miniature light string display container, provided with an opaque internal cover sheet for blocking non-lighted orifices.

FIG. 21 depicts an internal opaque cover sheet 120 on which the user can draw a desired pattern 122 and punch holes 124 at positions along the drawn pattern 122 corresponding to locations of orifices 14 which are along the pattern 122. Alternatively, one or a multiplicity of pattern suggestions 126 might be imprinted on the opaque cover sheet to allow the user to choose a desired pattern, rather, from among the suggested patterns. A black-colored paper cover sheet 120 is preferred to facilitate blocking light from projecting through any mounting orifices 14 which are not designated for insertion of a light bulb. Thus, unused light bulbs on a string may be conveniently enclosed within the display container without any unwanted projection of light through unused mounting orifices from reflected light or from any unused bulb or bulbs which can be conveniently enclosed within the container.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A miniature light string display container for selectively displaying a plurality of light bulbs of a miniature light string in a desired arrangement, said miniature light string container comprising:

(a) at least one display panel with a face;

(b) a rear surface on said at least one display panel opposite said face;

(c) an array of regularly spaced mounting openings of a predetermined size and shape through said at least one display panel for securely holding bulb portions of a standard miniature light string in selected ones of said mounting openings corresponding to a desired pattern selectable on said array of mounting openings;

(d) a reversibly openable entry panel with a closed position in which said entry panel is closed, adjacent to said rear surface of said display panel, and with an open second position in which said entry panel is opened away from said rear surface of said display panel for access thereto; and (e) means for allowing an electrical wire of said string of miniature ornamental lights to extend outside of said display container to an electrical power source so that said pattern of inserted light bulbs may be illuminated.

2. A miniature light string display container, as in claim 1, further comprising a string of miniature ornamental lights, including a plurality of small light bulbs attached along a length of electrical wire, said light bulbs sized for insertion from said rear surface into said mounting openings in said display panel in said desired arrangement or pattern which is selectable on said array of openings in said display.

3. A miniature light string display container, as in claim 1, wherein said container has a rectangular box shape, and at least one display panel comprises a front display panel, and said reversibly openable entry panel comprises a rear panel closeable parallel to said rear surface of said front panel, and further comprising, a side wall at each of four sides of said rectangular box shape of said container, each side wall extending between said parallel front and entry panels.

4. A miniature light string display container, as in claim 1, wherein said container has a multifaceted box shape, said at least one display panel comprises at least one of said facets of said container, and said reversibly openable entry panel corresponds to at least one other of said facets of said box.

5. A miniature light string display container, as in claim 3, wherein said at least one display panel comprises a plurality of display panels, each corresponding to a plurality of said facets of said container.

6. A miniature light string display container, as in claim 4, wherein said multi-faceted, box-shaped container comprises a pyramid-shaped container.

7. A miniature light string display container, as in claim 1, wherein said at least one display panel with said array of regularly spaced mounting openings therein comprises a trapezoidal shaped panel.

8. A miniature light string display container, as in claim 1, wherein said at least one display panel, having said array of regularly spaced mounting openings therein, comprises a circular-shaped panel.

9. A miniature light string display container, as in claim 1, wherein said at least one display panel, having said array of regularly spaced mounting opening therein, comprises a triangular-shaped panel.

10. A miniature light string display container, as in claim 1, wherein said container, having at least one display panel with said array of regularly spaced mounting openings formed therein, comprises a spherical-shaped container in which said at least one display panel comprises a face which is a portion of said spherical surface, and wherein said reversibly opening entry panel comprises another portion of said spherical surface which is movable out of alignment with said spherical surface for access thereinto.

11. A miniature light string display container, as in claim 1, wherein said container comprises a cylindrical-shaped container, having at least one closeable end forming said reversibly openable entry panel and in which said at least one display panel comprises at least a portion of said cylindrical surface of said container.

12. A miniature light display container, as in claim 1, wherein said small light bulbs of said miniature light string each have a cylindrical shape, each with a predetermined outside diameter, and wherein said predetermined size and shape of said mounting openings comprise a shape into which an imaginary circle can be inscribed, which circle has a diameter smaller than said outside said predetermined outside diameter of said light bulbs so that said light bulbs can be inserted through said mounting openings by deforming said display panel a small amount at said mounting openings.

13. A miniature light display container, as in claim 12, wherein said at least one display panel is composed of corrugated cardboard.

14. A miniature light display container, as in claim 12, wherein said at least one display panel is composed of corrugated plastic sheet material.

15. A miniature light display container, as in claim 12, wherein said mounting openings comprise a partially resiliently deformable material, such that around at least a portion of said openings so that said light bulbs may be inserted therethrough may be reversibly inserted thereinto by resiliently deforming said deformable portion of said openings.

16. A miniature light display container, as in claim 12, wherein said array of regularly spaced mounting openings comprise openings having a circular cross-section, such that a cylindrical opening is formed through the thickness of said display panel.

17. A miniature light display container, as in claim 12, wherein said array of regularly spaced mounting openings further comprise openings having a triangular cross-sectional shape.

18. A miniature light display container, as in claim 11, wherein said array of regularly spaced mounting openings comprise an array of evenly spaced square openings.

19. A miniature light display container, as in claim 1, further comprising a plurality of lenses, corresponding to the number of small light bulbs to be inserted through said mounting openings of said array of regularly spaced mounting openings, wherein said predetermined size and shape of said mounting openings correspond to the outside diameter of said lenses, said lenses having an inside diameter corresponding to the outside diameter of said light bulbs and having a predetermined outside diameter.

20. A miniature light display container, as in claim 19, wherein said plurality of lenses insertable into said array of mounting openings comprise multi-colored, translucent lenses by which the light display may be selectably provided with a desired color arrangement without having separately colored light bulbs.

21. A miniature light display container, as in claim 1, further comprising an opaque internal cover sheet, sized for overlaying said rear surface of said display panel and being pierceable at locations corresponding to mounting orifices into which said bulbs of said light string are to be inserted for selectably forming said desired pattern to be displayed.

22. A miniature light string display for selectively displaying a plurality of light in a desired arrangement, comprising:

(a) a container having at least one display panel with a face, a rear surface, an array of regularly spaced mounting openings of a predetermined size and shape through said at least one display panel, and said container having a reversibly openable entry panel with a closed position in which said entry panel is closed, adjacent to said rear surface of said display panel, and with an open second position in which said entry panel is opened away from said rear surface of said display panel for access thereto;

(b) a string of miniature ornamental lights, including a plurality of small light bulbs attached along a length of electrical wire, said light bulbs sized for insertion from said rear surface into said openings in said display panel in a desired arrangement or pattern which is selectable on said array of openings in said display; and (c) electrical connection means for connecting said electrical wire of said string of miniature ornamental lights to an electrical power source so that said pattern of inserted light bulbs may be illuminated.

* * * * *

UNITED STATES PATENT AND TRADEMARK OFFICE

CERTIFICATE OF CORRECTION

PATENT NO. : 5,555,163

DATED : September 10, 1996

INVENTOR(S) : Richard R. Pisani

It is certified that error appears in the above-indentified patent and that said Letters Patent is hereby corrected as shown below:

Column 3, Line 57--
Following: "display"
Delete: -- , --

Column 3, Line 58--
Replace: "the"
With: -- The --

Column 4, Line 40 --
Replace: "1;"
With: -- 1. --

Column 5, Lines 48 & 49 --
Replace: "manu- factures"
With: -- manu- facturers --

UNITED STATES PATENT AND TRADEMARK OFFICE

CERTIFICATE OF CORRECTION

PATENT NO. : 5,555,163

DATED : September 10, 1996

INVENTOR(S) : Richard R. Pisani

It is certified that error appears in the above-indentified patent and that said Letters Patent is hereby corrected as shown below:

Column 6, Line 23 --
Replace: "inter-connected"
With: -- interconnected --

Column 7, Line 16 --
Replace: "on"
With: -- one --

Signed and Sealed this

Fourth Day of February, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,555,163
DATED : September 10, 1996
INVENTOR(S) : Richard R. Pisani It is certified that error appears in the above-indentified patent and that said Letters Patent is hereby corrected as shown below:

Title page, item [76], Inventor's address should read-- 805 West 21st Avenue, Spokane, WA 99203--.

Signed and Sealed this

Twenty-sixth Day of August, 1997

*Attest:*

Bruce Lehman

BRUCE LEHMAN

*Attesting Officer*

*Commissioner of Patents and Trademarks*